US009726355B2

(12) United States Patent
Stathes et al.

(10) Patent No.: US 9,726,355 B2
(45) Date of Patent: Aug. 8, 2017

(54) ADJUSTABLE DUAL OPTIC DIRECTIONAL LAMP ASSEMBLY

(71) Applicant: Hubbell Incorporated, Shelton, CT (US)

(72) Inventors: Nancy R. Stathes, Hillsdale, NJ (US); Federico Collado, Jr., Westwood, NJ (US); Michael S. Swern, Boonton, NJ (US)

(73) Assignee: Hubbell Incorporated, Shelton, CT (US)

( * ) Notice: Subject to any disclaimer, the term of this patent is extended or adjusted under 35 U.S.C. 154(b) by 56 days.

(21) Appl. No.: 14/688,537

(22) Filed: Apr. 16, 2015

(65) Prior Publication Data

US 2015/0300612 A1 Oct. 22, 2015

Related U.S. Application Data

(60) Provisional application No. 61/980,445, filed on Apr. 16, 2014.

(51) Int. Cl.

| | |
|---|---|
| ***F21V 21/28*** | (2006.01) |
| ***F21V 19/02*** | (2006.01) |
| ***F21S 8/02*** | (2006.01) |
| *F21Y 113/00* | (2016.01) |
| *F21Y 115/10* | (2016.01) |

(52) U.S. Cl.

CPC ..... *F21V 21/28* (2013.01); *F21S 8/024* (2013.01); *F21S 8/026* (2013.01); *F21V 19/02* (2013.01); *F21Y 2113/00* (2013.01); *F21Y 2115/10* (2016.08)

(58) Field of Classification Search

CPC ..... F21V 21/28; F21S 8/024; F21S 8/026

See application file for complete search history.

(56) References Cited

U.S. PATENT DOCUMENTS

| | | | |
|---|---|---|---|
| 5,222,800 | A | 6/1993 | Chan et al. |
| 5,457,617 | A | 10/1995 | Chan et al. |
| 5,609,413 | A | 3/1997 | Lecluze |
| 5,951,151 | A | 9/1999 | Doubeck et al. |
| 6,994,456 | B1 | 2/2006 | Russo et al. |
| 8,002,425 | B2 | 8/2011 | Russo et al. |
| 8,021,013 | B2 | 9/2011 | Russo et al. |
| 8,684,571 | B1 | 4/2014 | Alaura et al. |
| 8,727,583 | B2 | 5/2014 | Russo et al. |
| 2010/0110698 | A1 | 5/2010 | Harwood et al. |
| 2010/0165646 | A1 | 7/2010 | Russo et al. |
| 2012/0044703 | A1 | 2/2012 | Wilson et al. |

OTHER PUBLICATIONS

PCT/US2015/026158 International Search Report and Written Opinion dated Jul. 13, 2015.

*Primary Examiner* — Elmito Breval

(74) *Attorney, Agent, or Firm* — Michael Best & Friedrich, LLP

(57) ABSTRACT

A light fixture includes an adjustable bracket, a pivot plate, a lamp bracket, and a lamp. The adjustable bracket is rotatable about a first axis. The pivot plate is connected to the adjustable bracket and rotatable about a second axis different from the first axis. The lamp bracket is removably connected to the pivot plate. The lamp is connected to the lamp bracket.

23 Claims, 12 Drawing Sheets

FOOTBANDLE VALUES AT NADIR, FIXTURES MOUNTED IN 15° SLOPE

| DISTANCE | 5′ | | | | | 10′ | | | | | 15′ | | | | | 20′ | | | | |
|---|---|---|---|---|---|---|---|---|---|---|---|---|---|---|---|---|---|---|---|---|
| | NADIR | 10° | | 15° | | NADIR | 10° | | 15° | | NADIR | 10° | | 15° | | NADIR | 10° | | 15° | |
| LAMPS | FC | FC | DIAM | FC | DIAM | FC | FC | DIAM | FC | DIAM | FC | FC | DIAM | FC | DIAM | FC | FC | DIAM | FC | DIAM |
| D4216 1000 lm 3000K | 118 | 104 | 2′ | 83 | 3′ | 30 | 26 | 4′ | 21 | 5′ | 13 | 12 | 5′ | 9 | 8′ | 7 | 7 | 7′ | 5 | 11′ |
| D4216 1300 lm 3000K | 159 | 142 | 2′ | 115 | 3′ | 40 | 35 | 4′ | 29 | 5′ | 18 | 16 | 5′ | 13 | 8′ | 10 | 9 | 7′ | 7 | 11′ |

CANDLEPOWER DISTRIBUTION

D4216 1000 lm 3000K
LER 50.9 S/M 0° .7
S/M 90° .7

CANDELAS

| ° | 0° | 90° |
|---|---|---|
| | 1625* | 1625* |
| 0 | 2958 | 2958 |
| 5 | 2945 | 2914 |
| 10 | 2758 | 2698 |
| 15 | 2340 | 2267 |
| 20 | 1678 | 1679 |
| 25 | 836 | 1130 |
| 30 | 403 | 593 |
| 35 | 108 | 253 |
| 40 | 63 | 107 |
| 45 | 38 | 25 |
| 50 | 28 | 15 |
| 55 | 20 | 10 |
| 60 | 15 | 7 |
| 65 | 12 | 4 |
| 70 | 10 | 3 |
| 75 | 8 | 3 |
| 80 | 6 | 3 |
| 85 | 4 | 2 |
| 90 | 0 | 0 |

° VERTICAL ANGLES
*LUMINAIRE LUMENS

D4216 1300 lm 3000K
LER 40.7 S/M 0° .6
S/M 90° .6

| ° | 0° | 90° |
|---|---|---|
| | 1871* | 1871* |
| 0 | 3971 | 3971 |
| 5 | 3928 | 3843 |
| 10 | 3707 | 3513 |
| 15 | 3185 | 2834 |
| 20 | 2179 | 1956 |
| 25 | 1474 | 1240 |
| 30 | 1054 | 536 |
| 35 | 354 | 244 |
| 40 | 134 | 73 |
| 45 | 93 | 23 |
| 50 | 65 | 13 |
| 55 | 45 | 9 |
| 60 | 33 | 4 |
| 65 | 25 | 1 |
| 70 | 19 | 0 |
| 75 | 14 | 0 |
| 80 | 10 | 0 |
| 85 | 6 | 0 |
| 90 | 0 | 0 |

° VERTICAL ANGLES
*LUMINAIRE LUMENS

ADJUSTABLE DUAL OPTIC DIRECTIONAL LAMP ASSEMBLY

CLAIM TO PRIORITY

This application is based on U.S. Provisional application Ser. No. 61/980,445, filed Apr. 16, 2015, the disclosure of which is incorporated herein by reference in its entirety and to which priority is claimed

FIELD

Various exemplary embodiments relate to lighting devices and to recessed lighting fixture assemblies.

BACKGROUND

Light fixtures, or luminaires, are used with electric light sources to provide aesthetic and functional housing in both interior and exterior applications. One type of light fixture is a recessed light, typically used for interior lighting to conceal the light fixture in a wall or ceiling. In recent years, lighting applications have trended towards the use of light emitting diodes (LEDs) as the light source in place of conventional incandescent and fluorescent lamps.

SUMMARY

According to an exemplary embodiment a light fixture includes an adjustable bracket, a pivot plate, a lamp bracket, and a lamp. The adjustable bracket is rotatable about a first axis. The pivot plate is connected to the adjustable bracket and rotatable about a second axis different from the first axis. The lamp bracket is removably connected to the pivot plate. The lamp is connected to the lamp bracket.

In another exemplary embodiment, a light fixture assembly includes an adjustable bracket, a pivot plate, and a lamp. The adjustable bracket is infinitely positionable through a first range of angles about a first axis. The pivot plate is connected to the adjustable bracket and infinitely positionable through a second range of angles about a second axis different from the first axis. The lamp is connected to the pivot plate.

Other exemplary embodiments relate to a method of adjusting a light fixture assembly. An adjustable bracket is rotated and selectively positioned about a first axis to position a lamp. The adjustable bracket is secured from rotating about the first axis with a first securing element. A pivot plate is rotated and selectively positioned about a second axis to further position the lamp. The pivot plate is secured about from rotating about the second axis with a second securing element.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
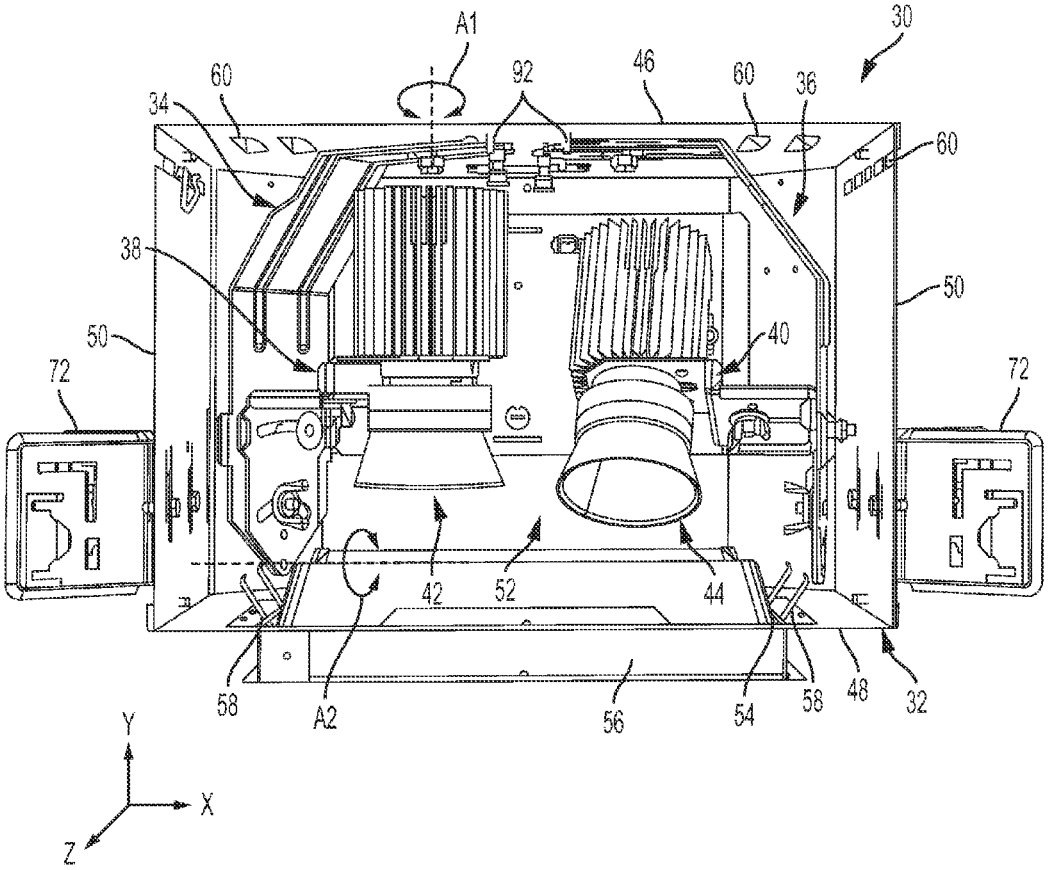
FIG. 1 is a side, cut-away view of a light fixture assembly and housing according to an exemplary embodiment.
Figure 2:
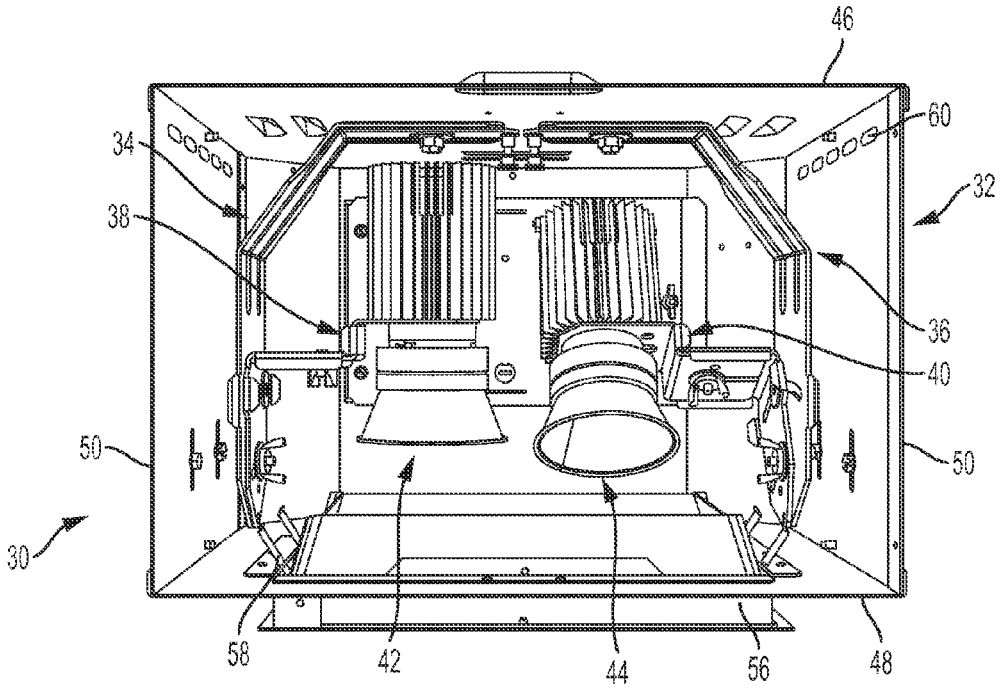
FIG. 2 is another side, cut-away view of the light fixture assembly of FIG. 1.
Figure 3:
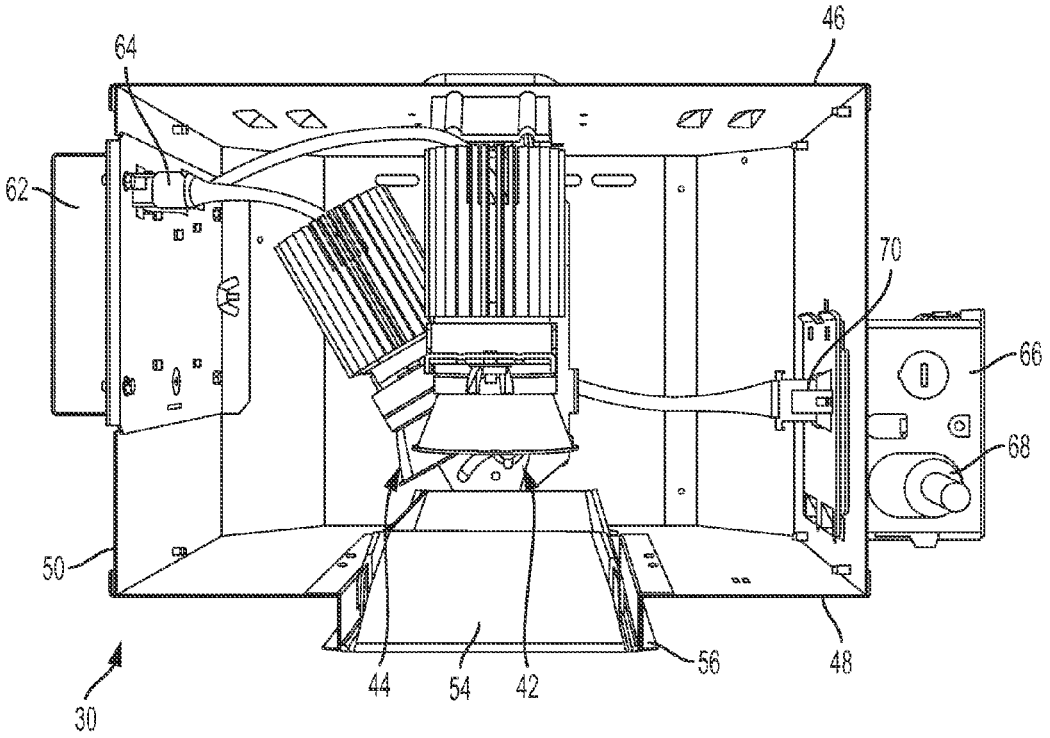
FIG. 3 is another side, cut-away view of the light fixture assembly of FIG. 1 showing a junction box and driver box attached to the housing.
Figure 4:
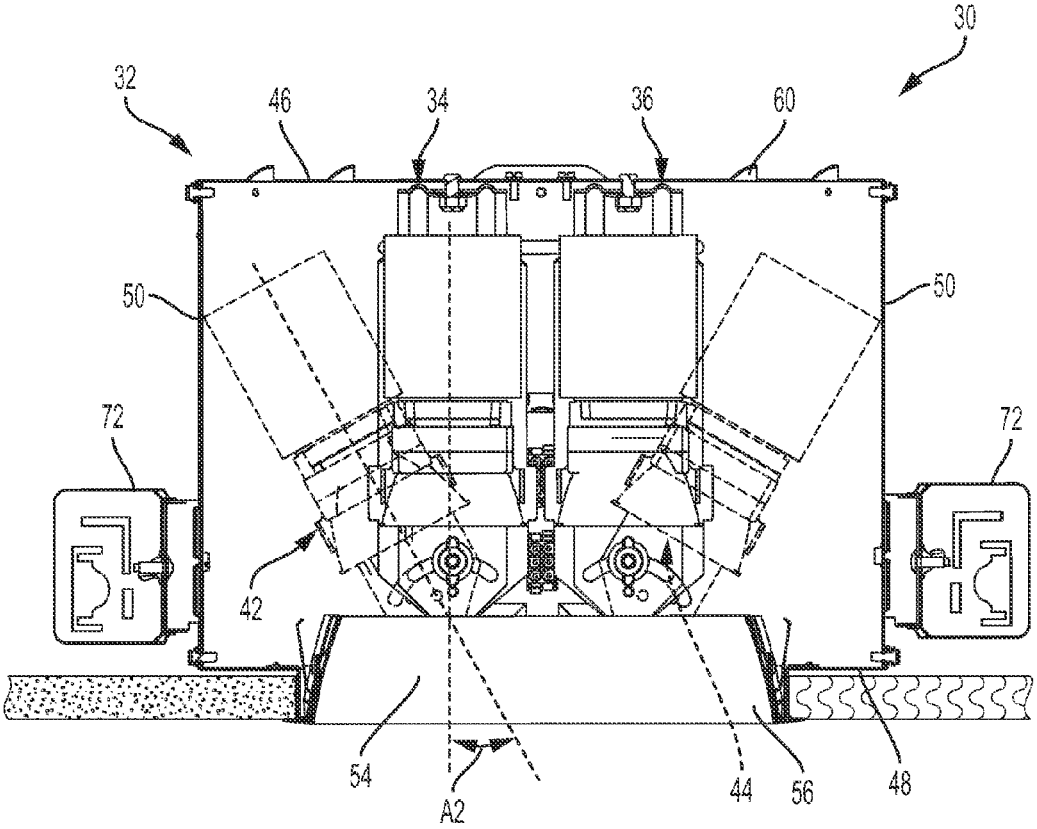
FIG. 4 is another side, cut-away view of the light fixture assembly of FIG. 1.
Figure 5:
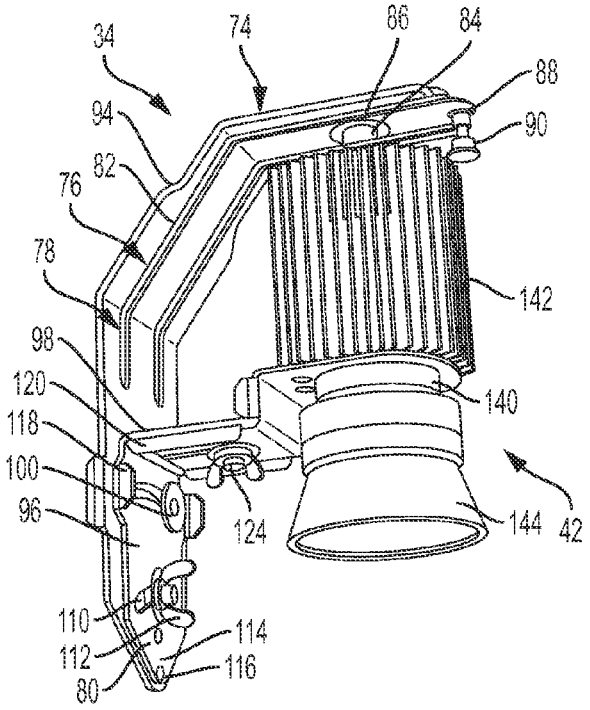
FIG. 5 is a perspective view of the adjustable bracket, lamp bracket, and lamp assembly of FIG. 1.
Figure 6:
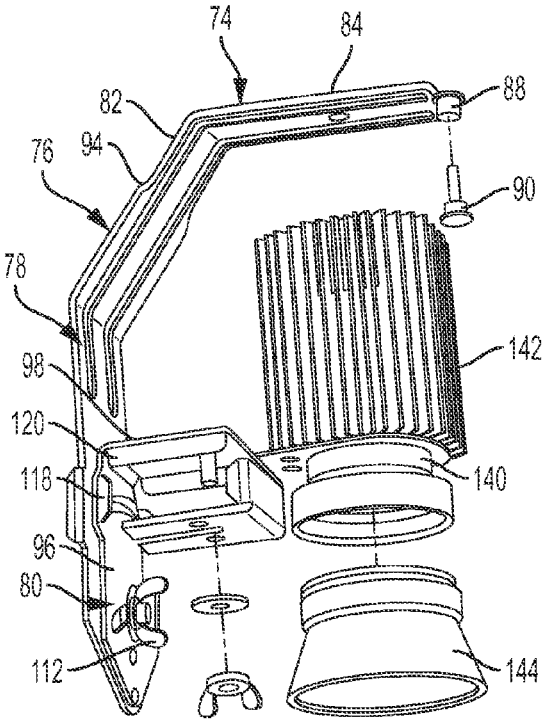
FIG. 6 is a perspective, exploded view of FIG. 5.

Referring to FIG. 1, a light fixture assembly 30 allows a user to adjust the position of one or more light sources. In an exemplary embodiment, the light fixture assembly 30 includes a housing 32, a first adjustable bracket 34, a second adjustable bracket 36, a first lamp bracket 38, a second lamp bracket 40, a first lamp assembly 42, and a second lamp assembly 44. The first and second adjustable brackets 34, 36 enable the lamp assemblies 40, 42 to be rotated an angle A1 about a first axis and an angle A2 about a second axis to selectively adjust and position light emitted from a housing 32. The drawings illustrate the adjustable brackets 34, 36 used in connection with a recessed lighting assembly that may be positioned in the recess of a ceiling or wall. The adjustable brackets 34, 36, however, may be used with any type of housing 32, frame, or mounted directly to a surface or structure.

As best shown in FIGS. 1-4, the housing 32 includes a top wall 46, a bottom wall 48, and a plurality of side walls 50 surrounding a central chamber 52. In certain embodiments, the top, bottom, or sides of the housing 32 can be open. A bottom opening 54 is provided in the bottom wall 48 to allow light to be directed from the housing 32. A trim member 56 may extend through the bottom opening 54 and be connected to the housing 32 by one or more spring retainer arms 58. In various exemplary embodiments, one or more vents 6*o* are provided in the housing 32 to dissipate heat. Depending on the type of light source, a driver housing 62 extends from one of the side walls 50 and houses an electronic driver (not shown). The first and second lamp assemblies 42, 44 are connected to the driver through one or more driver plugs 64. A junction box 66 can extend from one of the sidewalls and houses a circuit junction (not shown) and a thermal protector 68. A plug on the driver box 64 receives electrical power connected to the junction box 66 by a junction plug 70. The housing 32 also includes a pair of rail supports 72 to connect the housing 32 to a track or rail. The rail supports 72 permit vertical adjustment of the housing 32 with respect to an opening in a ceiling or wall.

Because the adjustable brackets 34, 36, lamp brackets 38, 40, and lamp assemblies 42, 44 shown in FIGS. 1-13 are substantially identical, only a single adjustable bracket 34, lamp bracket 38, and lamp assembly 42 are described as needed. As discussed in further detail below, different lamp assemblies, examples of which are shown in FIGS. 1 and 14-21, may be used with the exemplary adjustable brackets 34, and can be swapped as desired. In various exemplary embodiments, a single adjustable bracket 34 or more than two adjustable brackets 34, 36 may be included in a single housing 32 as needed and space permits. The use of two adjustable brackets 34, 36, however, may permit a full 360 degree range of light projection for a given housing 32.

The adjustable bracket 34 allows the lamp assembly 42 to be rotated about more than one axis, for example the Y-axis and the X-axis as illustrated in FIGS. 1-4. In an exemplary embodiment, the lamp assembly 42 is capable of rotating an angle A1 that is between 0 and approximately 180 degrees about the Y-Axis and is capable of rotating an angle A2 that is between 0 and approximately 60 degrees about the X-axis. In certain instances, the angle A2 about the X-axis may be between 0 and approximately 30 degrees. An angle of 0 degrees may be a base reference point or established as a factory set position. For example, the lamp assembly 42 may be positioned at a mid-point of the housing 32 for rotation about Y-axis and the lamp assembly 42 facing straight down with respect to the housing 32 for rotation about the X-axis. Accordingly, the rotation angle A1 about the Y-axis may then be considered between approximately −90 degrees and approximately 90 degrees and the rotation angle A2 about the X-axis may be considered between approximately −30 degrees and approximately +30 degrees or approximately −15 degrees and approximately +15 degrees. The amount of rotation about the X-axis and Y-axis may be varied depending on the space requirements of the housing 32.

As best shown in FIGS. 5-9, and according to various exemplary embodiments, the adjustable bracket 34 includes a top arm 74, a middle arm 76 extending from the top arm 74, a side arm 78 extending from the middle arm 76, and a pivot plate 80 connected to the side arm 78. The top arm 74, middle arm 76, and side arm 78 can be unitarily formed or formed from separate pieces and connected. First and second ribs 80 extend from the adjustable bracket 34, for example from the top arm 74, middle arm 76, and the side arm 78 to increase strength and provide stability.

According to an exemplary embodiment, the top arm 74 extends along a portion of the top wall 46 of the housing 32. The top arm 74 can be parallel to the top wall 46 (as shown) or angled thereto. The length, position, and configuration of the top arm 74 can be adjusted depending on the light source, the housing, and other structural and design configurations. The top arm 74 has a substantially planar surface apart from the ribs 80 which extend above the top arm 74 towards the top wall 46 of the housing 32. A first aperture 84, for example a circular opening, extends through the top arm 74. The first aperture 84 receives a mechanical fastener 86 that connects the top arm 74 to the top wall 46 of the housing 32, for example a bolt, nut, and washer assembly. The connection through the first aperture 84 therefore connects the adjustable bracket 34 to the housing 32. The adjustable bracket 34 is connected in a manner that allows it to rotate about the mechanical fastener 86. In other exemplary embodiments, a pin, rivet, bearing, or other rotatable connection may be used to connect the adjustable bracket 34 to the housing 32. The rotatable connection allows the adjustable bracket 34 to be infinitely positioned along a certain range, for example a 180 degree range as described above.

The top arm 74 can also include a securing element to resist or prevent unwanted rotation. At a point spaced from the first aperture 84, a projection 88 extends from the top arm 74. According to an exemplary embodiment, the projection 88 is a cylindrical sleeve having an internal thread for receiving a threaded mechanical fastener. The threaded mechanical fastener acts as a set screw 90 to secure or lock the position of the adjustable bracket 34 about the Y-axis. The set screw 90 may engage a planar surface of the top wall 46 or it may fit into depressions, apertures, threaded apertures, or a slot formed in the top wall 46. In various exemplary embodiments, the set screw 90 is replaced with a spring loaded pin (not shown) that engages the planar surface, a slot, or a plurality of holes formed in the top wall 46. The plurality of holes may be prepositioned at set angles. In certain embodiments, a combination of these features may be used so that a user can selectively position the adjustable bracket 34 at any point along the adjustable bracket's arc, while also having a visual or tactile reference at predetermined, set angles or intervals. Stops 92, for example posts, projections, or other stops, may extend from the top wall 46 to limit rotation of the adjustable bracket 34 about the Y-axis. Demarcations in the housing 32, for example angle graduations or markers can assist in positioning the adjustable bracket 34 about the Y-axis and the securing element can assist in retain the adjustable bracket 34 at a selected position.

As best shown in FIGS. 5-8, and in accordance with further exemplary embodiments, the middle arm 76 extends from the top arm 74 obliquely towards one of the side walls 50 and the bottom wall 48. The side arm 78 extends from the middle arm 76 towards the bottom wall 48. The middle arm 76 narrows or tapers at a point to form a first and second shoulder 94. In the exemplary embodiment shown, the middle arm 76 is angled at approximately 45 degrees to the top arm 72 and the side arm 78, although this angle may vary depending on the lamp assembly 42, the housing 32, and the desired light output. The length, position, and configuration of the middle arm 76 and side arm 78 can be adjusted depending on the light source, the housing, and other structural and design configurations. In certain embodiments, the middle arm 76 is omitted and the top arm 74 is connected directly to the side arm 78.

The pivot plate 80 has a first portion 96 that rotatably connects to the side arm 78 and a second portion 98 that connects to the lamp bracket 38. The pivot plate 80 rotates with respect to the side arm 78 about the X-axis to angle the lamp assembly 42. A tension assembly and a securing element assist a user in adjusting and retaining the position of the pivot plate. For example, the side arm 78 includes a first side aperture, for example a circular opening or arcuate slot, and the pivot plate 80 includes an arcuate first slot 100. A tension assembly, best shown in FIGS. 8 and 9, extends through the first side aperture and the first slot 100. The tension assembly includes a bolt 102, a nut 104, a washer 106, and a biasing member 108, for example a compression spring. The nut 104 is tightened to compress the spring 108 and insure a frictional connection between the side arm 78 and the pivot plate 80. This connection assists in adjusting and retaining the pivot plate 80 in a desired position. The side arm 78 also includes a second side aperture, for example a circular opening or arcuate slot, and the pivot plate includes an arcuate second slot 110. In an exemplary embodiment, the first side aperture is a slot substantially similar to the first slot 100 and the second aperture is a circular opening approximately or slightly greater than the size of the bolt. A mechanical fastener, for example a bolt and wing nut 112, extends through the second side aperture and the second slot 110. A user, for example a manufacturer or installer, may selectively loosen the wing nut 112 to adjust the position of the pivot plate 80, rotating the pivot plate 80 with respect to the side arm 78 and sliding the second slot 110 about the bolt and wing nut 112.

In an exemplary embodiment, the side arm 78 and the pivot plate 80 include a bottom section 114 that narrows in a V-shape to a rounded point. Proximate to the rounded point, the side arm 78 and the pivot plate 80 include a third aperture that receives a pin 116 rotatably connecting the side arm 78 to the pivot plate 80. The rotation of the side arm 78 to the pivot plate 80 is about the longitudinal axis of the pin 116. The pivot plate 80 also includes a pair of flanges 118 that assist in supporting or aligning the lamp bracket 38 with the adjustable bracket 34.

Figure 7:
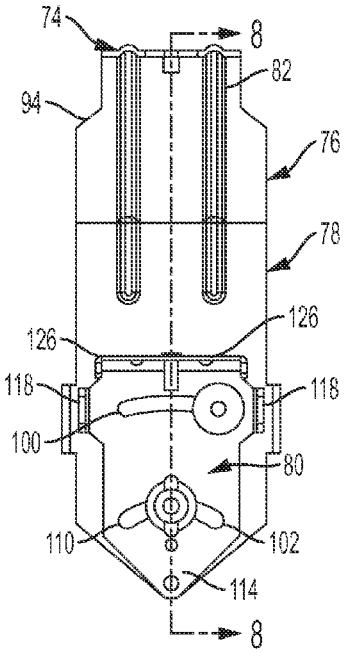
FIG. 7 is a front elevational view of the adjustable bracket of FIG. 1.
Figure 8:
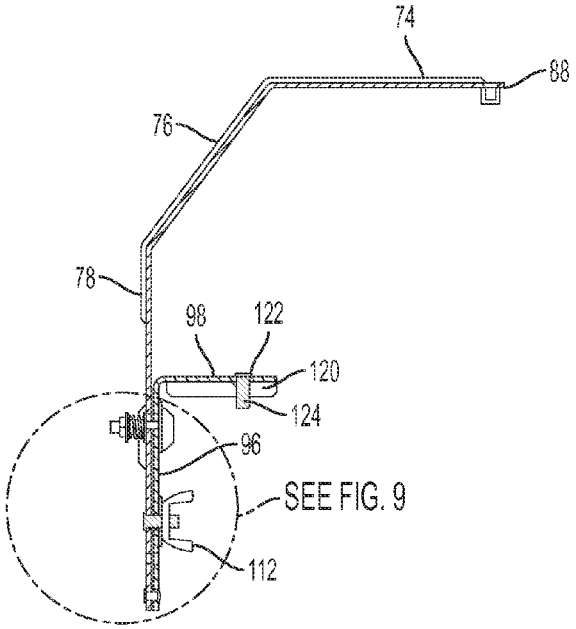
FIG. 8 is a side, sectional view of FIG. 7 taken along line 8-8.
Figure 9:
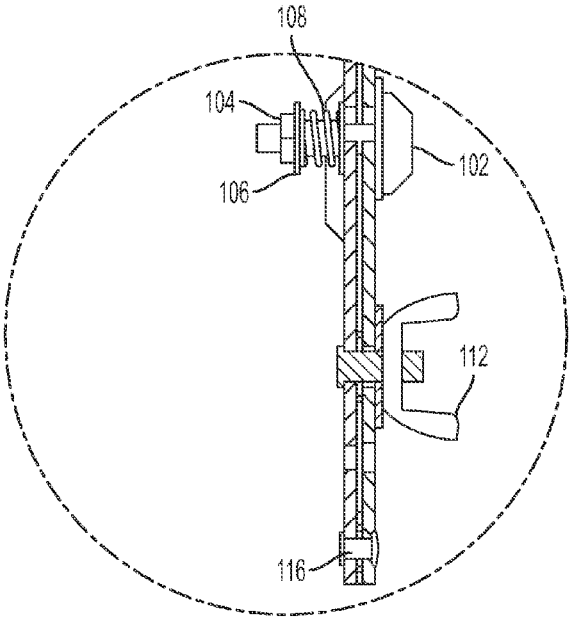
FIG. 9 is a magnified view of the area in FIG. 8 indicated by the circle 9.
Figure 10:
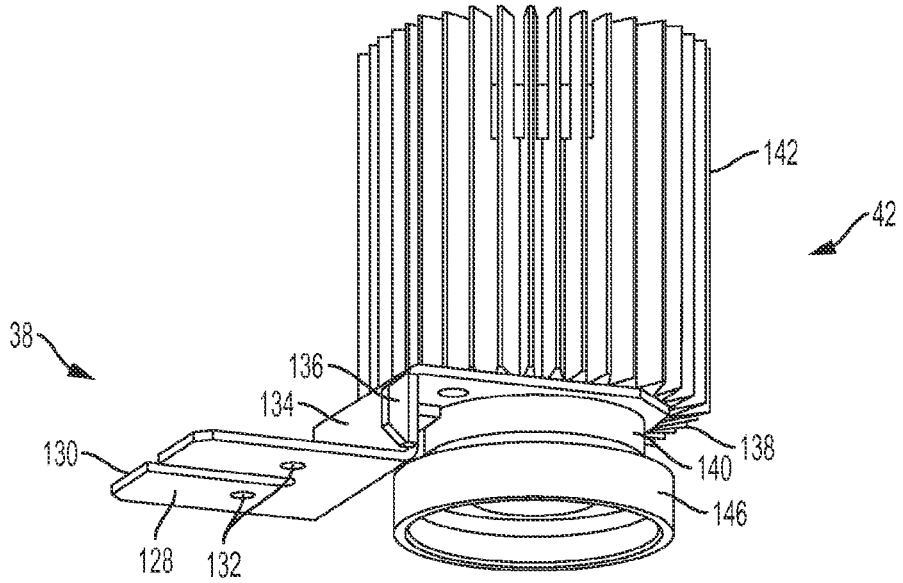
FIG. 10 is a perspective view of the lamp bracket and lamp assembly of FIG. 1 without a primary reflector.

As best shown in FIG. 8, the second portion 98 of the pivot plate 80 extends from the first portion 96 at a substantially right angle. The second portion 98 includes a base having a substantially planar top surface and first and second tabs 120 extending from the base toward the bottom wall 48 of the housing 32 to receive and align the lamp bracket 38. Although not shown, the first and second tabs 120 may be angled or include one or more feet extending therefrom to additionally support and/or align the lamp bracket 38. The base includes an aperture 122, for example a circular opening or substantially U-shaped slot to receive a mechanical fastener 124, for example a pin or bolt and wing nut. The mechanical fastener 124 extends through the base to connect the pivot plate 80 to the lamp bracket 38. As best shown in FIG. 7, a first and second protrusion 126 can extend from the bottom of the second portion 98 to align with depressions or openings in the lamp bracket 38.

Figure 11:
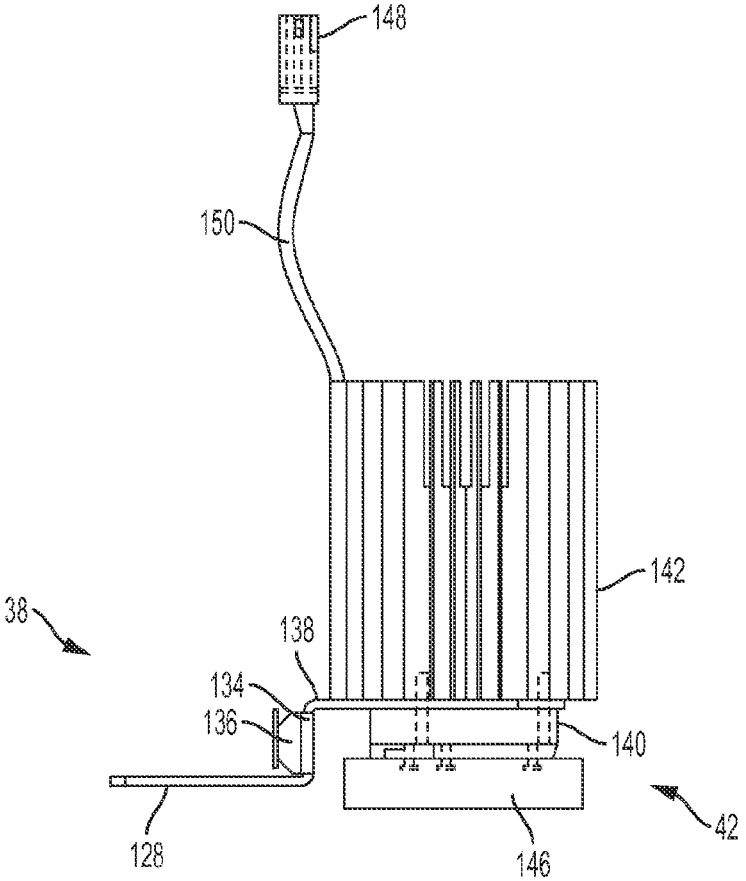
FIG. 11 is side elevation of FIG. 10 including a cord and plug for the lamp assembly.
Figure 12:
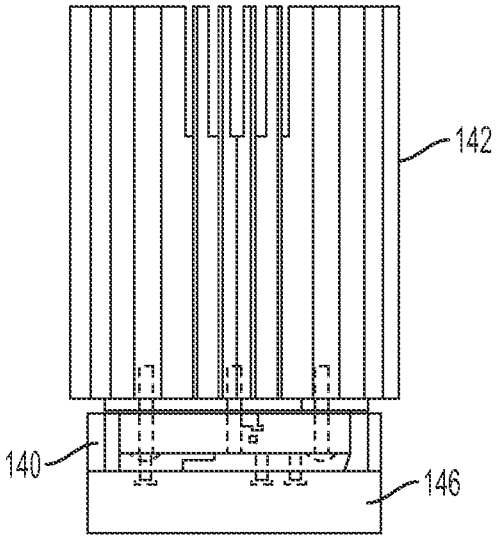
FIG. 12 is a front elevation of FIG. 10.
Figure 13:
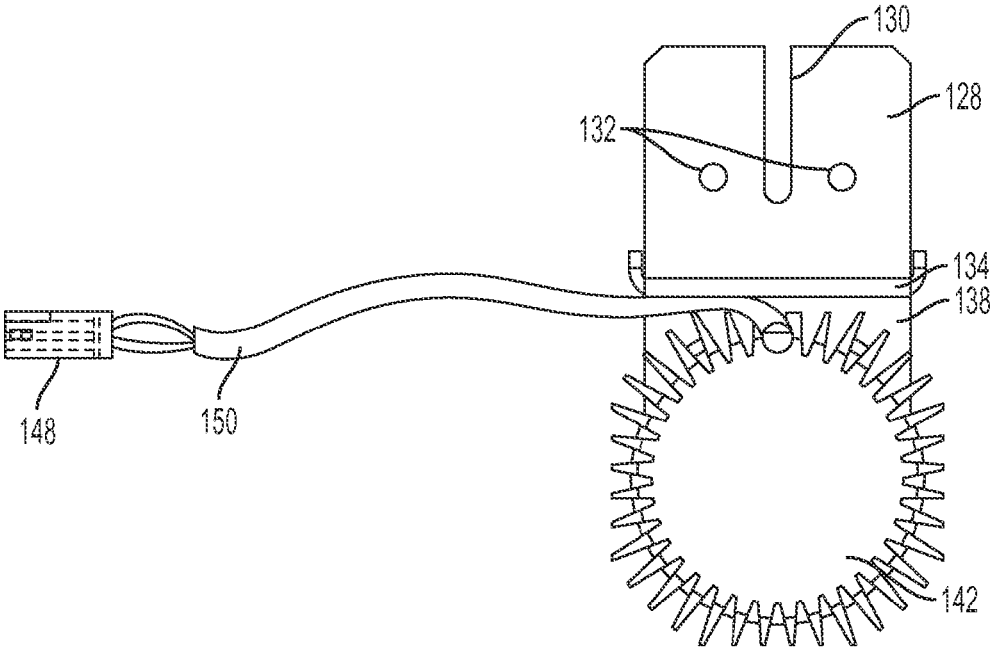
FIG. 13 is a top view of FIG. 11.

As best shown in FIGS. 11-13, the lamp bracket 38 includes a first section 128 having a slot 130, for example an open ended or U-shaped slot, for receiving the mechanical fastener 124 from the pivot plate 80. The U-shaped slot 130 allows a user to slide the lamp bracket 38 onto the mechanical fastener 124 without removing the fastener hardware, or any portion thereof. The U-shaped slot 130 may also allow a user to laterally adjust the position of the lamp assembly 42 with respect to the adjustable bracket 34. The first section 128 also includes a pair of depressions or openings 132 that receive the first and second protrusions 126, respectively, from the pivot plate 80 to assist in correct placement of the lamp bracket 38 with respect to the pivot plate 80. A second section 134 extends from the first section 128 towards the top wall 46 of the housing 32 at approximately a right angle, although other angles can be used. First and second flanges 136 extend from the second section 134 to assist in aligning the lamp bracket 38 with the pivot plate 80. A third section 138 extends from the second section 134 away from the pivot plate 80 at approximately a right angle, although other angles can be used. The third section 134 includes one or more openings to connect the lamp bracket 38 to a lamp assembly 42.

In various exemplary embodiments, the lamp assembly 42 includes a light source 140, a heat sink 142, and a primary reflector 144. The light source 140 is connected to the heat sink 142 by one or more mechanical fasteners, for example threaded bolts or screws, that extend through the third section 138 of the lamp bracket 38. The light source 140 includes a flange 146 for receiving the primary reflector 144. The flange 146 may be unitary with the light source 140 or separately connected, for example by a mechanical fastener, a snap fit, twisting, or bayonet connection. The primary reflector 144 may be similarly connected to the flange 146 by a threaded connection, a mechanical fastener, a snap fit, twisting, or bayonet connection. The light source 140 includes one or more plugs 148 that connect to the driver 62 and/or the junction box 66 as discussed above. A cord 150 extends through a slot, in the heat sink 142, positioning the cord 150 so that it will not hinder movement of the lamp assembly 42 and the adjustable bracket 34.

As best shown in FIGS. 14-21, and in accordance with further exemplary embodiments, various lamp assemblies and light sources are used in connection with the adjustable bracket 34 or other exemplary embodiments thereof. For example, configuration of the lamp bracket 38 varies according to the configuration of the lamp assembly 42.

Figure 14:
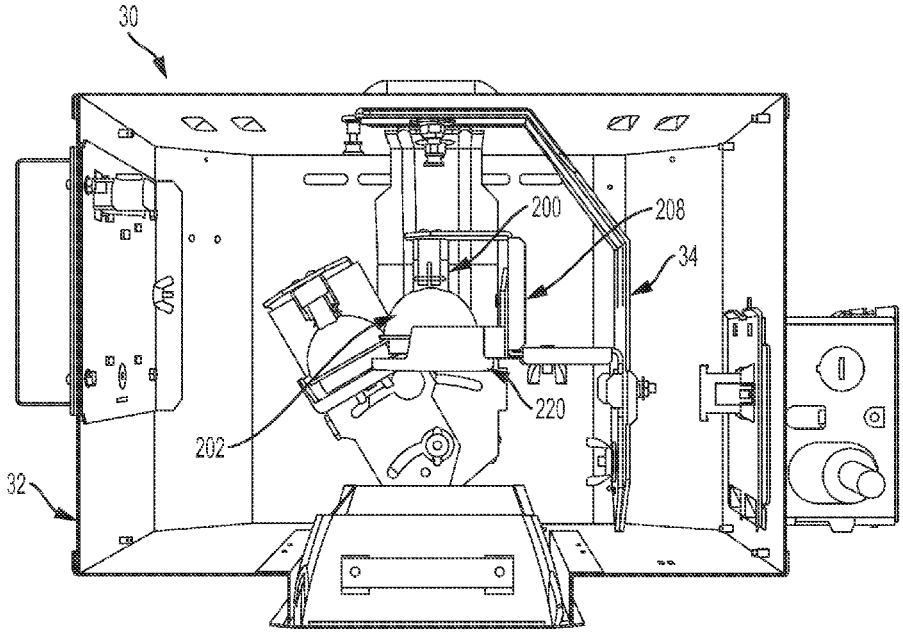
FIG. 14 is a cut-away view of a light fixture assembly and housing according to another exemplary embodiment.
Figure 15:
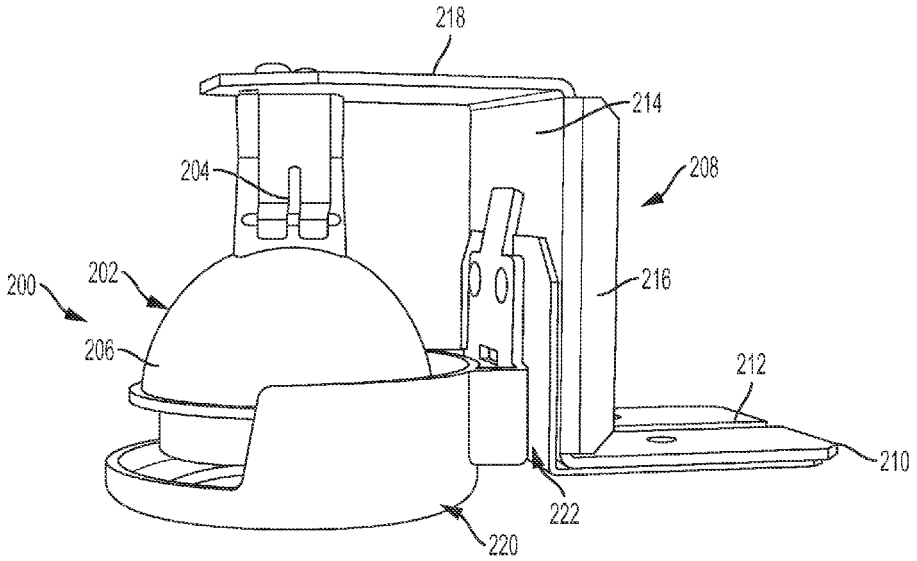
FIG. 15 is a perspective view of the lamp bracket and lamp assembly of FIG. 14.

FIGS. 14 and 15 illustrate another exemplary lamp assembly 200 used in connection with, for example, an MR16 LED light source 202 that utilizes a pin connection 204 and a reflector 206. The light source 202 is connected to an exemplary lamp bracket 208 that includes a first section 210 having a slot 212, for example a U-shaped slot, for receiving a mechanical fastener 124 from the pivot plate 80. The U-shaped slot 212 allows a user to slide the lamp bracket 208 onto the mechanical fastener 124 without removing the fastener hardware. The U-shaped slot 212 may also allow a user to laterally adjust the position of the lamp assembly 200 with respect to the adjustable bracket 36. A second section 214 extends from the first section 210 towards the top wall 46 of the housing 32 at approximately a right angle, although other angles can be used. First and second flanges 216 extend from the second section 214 to assist in aligning the lamp bracket 208 with the pivot plate 80. A third section 218 extends from the second section 214 away from the pivot plate 80 at approximately a right angle, although other angles can be used. The third section 218 includes one or more openings to connect the lamp bracket 208 to the lamp assembly 200.

According to an exemplary embodiment, an accessory holder 220 is connected to the lamp bracket 208. The accessory holder 220 is mechanically attached to the lamp bracket 208, for example through an accessory holder bracket 222 and/or one or more mechanical fasteners. Various accessories may be permanently or removably placed in the accessory holder 200, including lenses, color filters, or guards to prevent light spillover.

Figure 16:
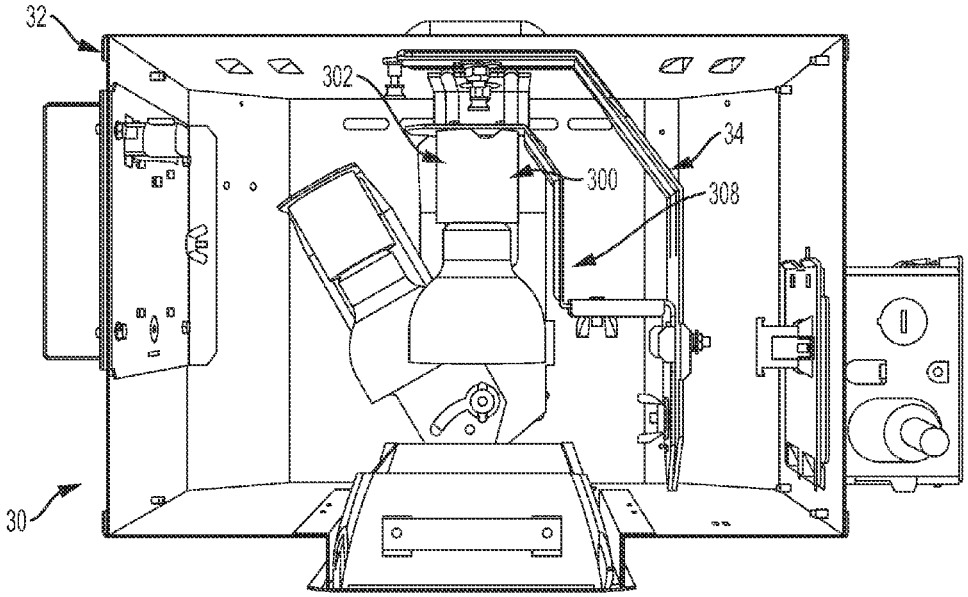
FIG. 16 is a cut-away view of a light fixture assembly and housing according to another exemplary embodiment.
Figure 17:
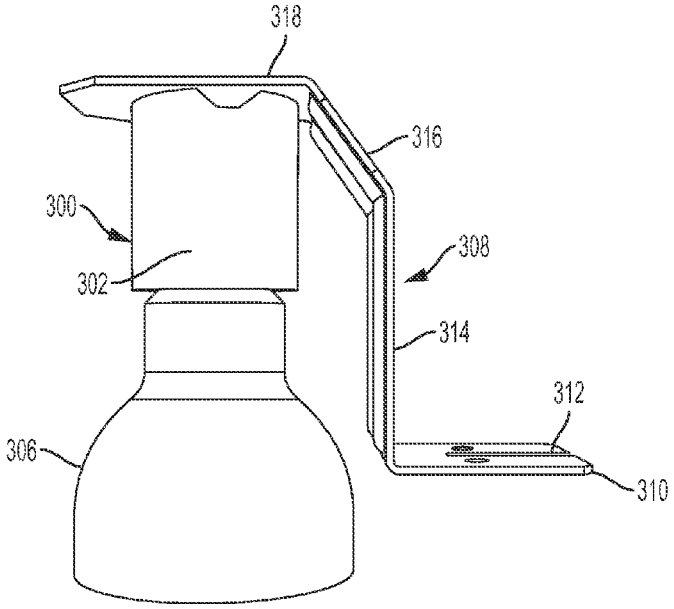
FIG. 17 is a perspective view of the lamp bracket and lamp assembly of FIG. 16.

FIGS. 16 and 17 illustrate another exemplary lamp assembly 300 used in connection with, for example, a PAR LED light source 302 and a reflector 306. The light source 302 is connected to another exemplary lamp bracket 308 that includes a first section 310 having a slot 312, for example a U-shaped slot, for receiving a mechanical fastener 124 from the pivot plate 80. The U-shaped slot 312 allows a user to slide the lamp bracket 308 onto the mechanical fastener 124 without removing the fastener hardware. The U-shaped slot 312 may also allow a user to laterally adjust the position of the lamp assembly 300 with respect to the adjustable bracket 36. A second section 314 extends from the first section 310 towards the top wall 46 of the housing 32 at approximately a right angle, although other angles can be used. A third section 316 extends from the second section 314 at an approximately 45 degree angle, although other angles can be used. A fourth section 318 extends from the third section 316 away from the pivot plate 80 at approximately a right angle, although other angles can be used. The fourth section 318 includes one or more openings to connect the lamp bracket 308 to the lamp assembly 300.

Figure 18:
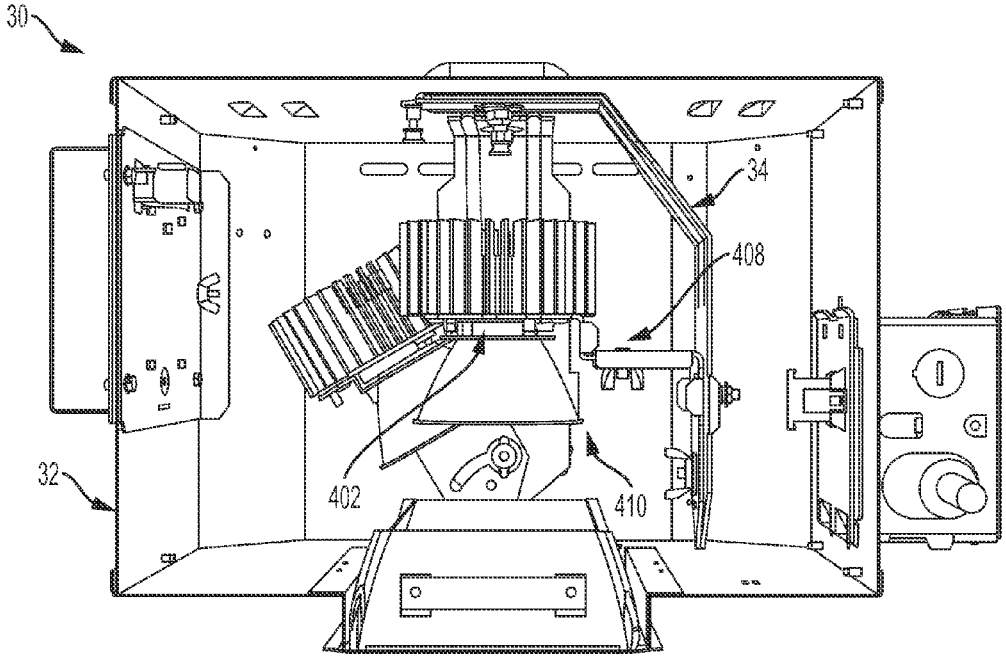
FIG. 18 is a cut-away view of a light fixture assembly and housing according to another exemplary embodiment.
Figure 19:
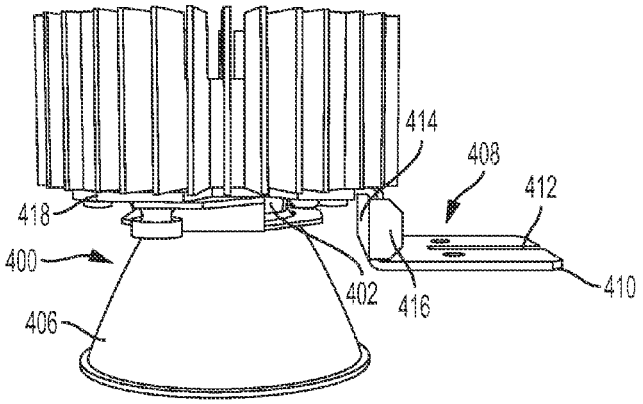
FIG. 19 is a perspective view of the lamp bracket and lamp assembly of FIG. 18.

FIGS. 18 and 19 illustrate another exemplary lamp assembly 400 used in connection with ZHAGA® type interchangeable light source 402 and a reflector 406. The light source 402 is connected to an exemplary lamp bracket 408 that includes a first section 410 having a slot 412, for example a U-shaped slot, for receiving a mechanical fastener 124 from the pivot plate 80. The U-shaped slot 412 allows a user to slide the lamp bracket 408 onto the mechanical fastener 124 without removing the fastener hardware. The U-shaped slot 412 may also allow a user to laterally adjust the position of the lamp assembly 400 with respect to the adjustable bracket 36. A second section 414 extends from the first section 410 towards the top wall 46 of the housing 32 at approximately a right angle, although other angles can be used. First and second flanges 416 extend from the second section 414 to assist in aligning the lamp bracket 408 with the pivot plate 80. A third section 418 extends from the second section 414 away from the pivot plate 80 at approximately a right angle, although other angles can be used. The third section 418 includes one or more openings to connect the lamp bracket 408 to the lamp assembly 400.

Figure 20:
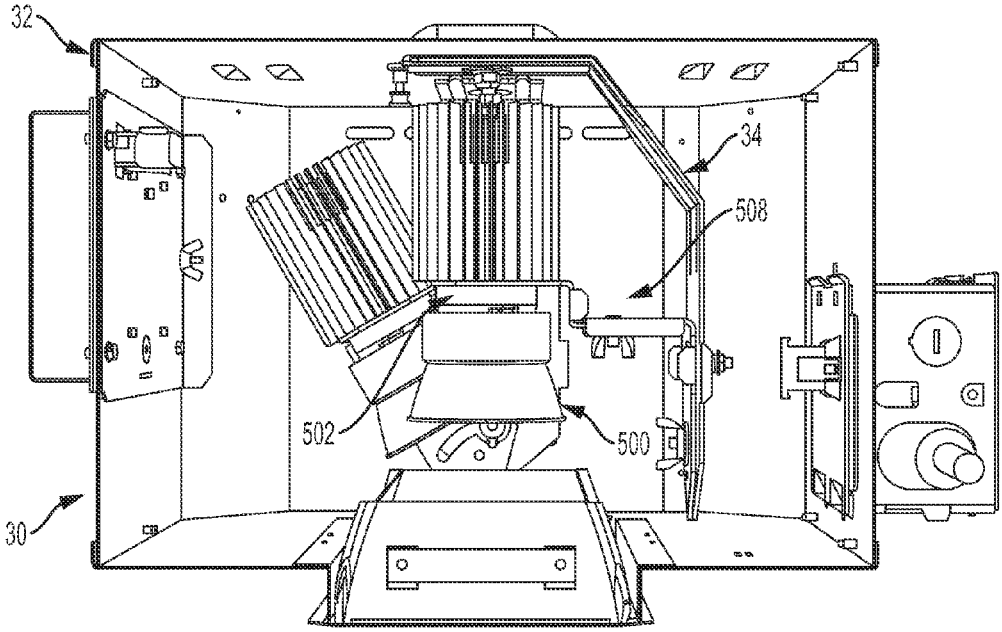
FIG. 20 is a cut-away view of a light fixture assembly and housing according to another exemplary embodiment.
Figure 21:
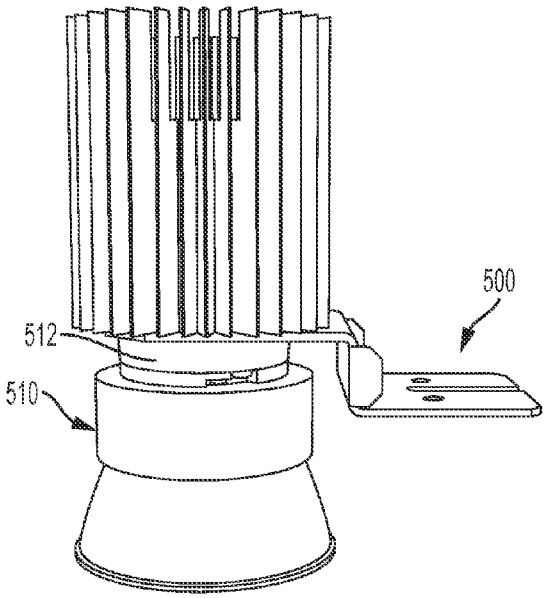
FIG. 21 is a perspective view of the lamp bracket and lamp assembly of FIG. 20.

FIGS. 20 and 21 illustrate another exemplary lamp assembly 400 used in connection with an LED module light source 502, for example a XICATO® remote phosphor LED and a reflector 506. The light source 502 is connected to an exemplary lamp bracket 508 that includes a first section 510 having a slot 512, for example a U-shaped slot, for receiving a mechanical fastener 124 from the pivot plate 80. The U-shaped slot 512 allows a user to slide the lamp bracket 508 onto the mechanical fastener 124 without removing the fastener hardware. The U-shaped slot 512 may also allow a user to laterally adjust the position of the lamp assembly 500 with respect to the adjustable bracket 36. A second section 514 extends from the first section 510 towards the top wall 46 of the housing 32 at approximately a right angle, although other angles can be used. First and second flanges 516 extend from the second section 514 to assist in aligning the lamp bracket 508 with the pivot plate 80. A third section 518 extends from the second section 514 away from the pivot plate 80 at approximately a right angle, although other angles can be used. The third section 518 includes one or more openings to connect the lamp bracket 508 to the lamp assembly 500.

Figure 22:
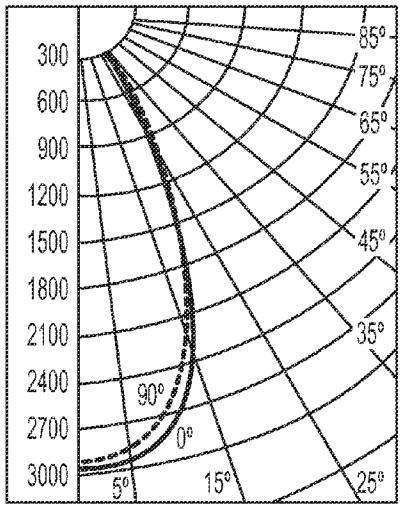
FIG. 22 is a candlepower distribution chart for the output of an exemplar light fixture assembly.
Figure 22:
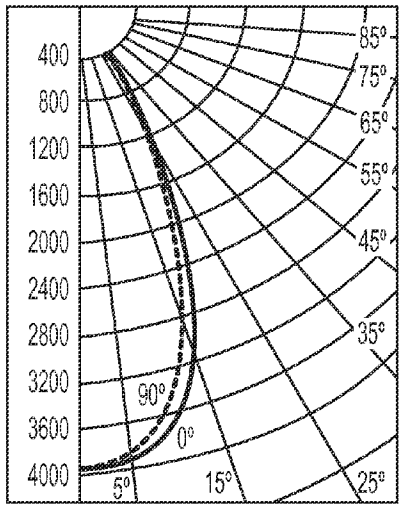

In operation, the adjustable brackets 34, 36 allow various lamp assemblies to be selectively positioned by a user. Each lamp assembly can be rotated about the Y-axis and about the X-axis. The freedom of movement provided by the adjustable brackets 34, 36 allows the light emitted from the housing 32 to cover a wide area, allows for two different objects to be lighted from a single fixture, and also allows lighting effects to be created by angling or crossing the beams from two different light sources. Such variable lighting is useful, for example, in highlighting art, merchandise, accentuating architectural features, and creating a desired lighting ambiance. FIG. 22 shows the candlepower distribution chart illustrating the light intensity for the light fixture assembly 30 at different vertical and horizontal angles from the light source. As understood by one of ordinary skill in the art, the output of the light fixture assembly 30 will vary based on the adjustment of the lamp assemblies 42, 44. Any of the light sources described above and various other light sources may be used with the adjustable bracket 34. The connection to the pivot plate 80 allows various lamp assemblies to be selectively connected to the adjustable bracket 34 in a modular fashion. Different lamp assemblies can easily be swapped in a particular housing, frame, or other structure without removal of the a fastener or any component thereof.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present application, and are not intended to limit the structure of the exemplary embodiments of the present application to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A light fixture assembly comprising:

an adjustable bracket rotatable about a first axis configured to extend through a structural opening;

a pivot plate connected to the adjustable bracket and rotatable about a second axis different from the first axis;

a lamp bracket movably connected to the pivot plate to adjust the position of the lamp bracket in the direction of the second axis and relative to the structural opening; and a lamp connected to the lamp bracket.

2. The light fixture of claim 1, wherein the adjustable bracket includes an aperture and the pivot plate includes an arcuate slot aligned with the aperture.

3. The light fixture of claim 2, wherein a tensioning assembly passes through the aperture and the arcuate slot.

4. The light fixture of claim 2, wherein a securing element passes through the aperture and the arcuate slot.

5. The light fixture of claim 1, wherein the lamp bracket slidably engages the pivot plate.

6. The light fixture of claim 1, wherein the lamp bracket includes an open ended slot for slidably receiving a fastener connected to the pivot plate.

7. The light fixture of claim 6, wherein the lamp bracket can be connected to and removed from the pivot plate without removable of a fastener component.

8. The light fixture of claim 1, wherein the adjustable bracket is rotatably connected to the top wall of a housing.

9. The light fixture of claim 8, wherein a securing element extends through the adjustable bracket to engage the top wall.

10. The light fixture of claim 1, wherein the lamp bracket includes a first section, a second section extending above the first section, and a third section extending from the second section and away from the first section.

11. The light fixture of claim 1, wherein the pivot bracket includes a first portion connected to the adjustable bracket and a second portion spaced above the first portion and extending from the first portion toward the structural opening, and wherein the lamp bracket is connected to the second portion.

12. The light fixture of claim 1, wherein a flange extends from the pivot bracket to support the lamp bracket in the direction of the first axis.

13. A light fixture assembly comprising:

an adjustable bracket infinitely positionable through a first range of angles about a first axis;

a pivot plate rotatably connected to the adjustable bracket and infinitely positionable through a second range of angles about a second axis different from the first axis;

a tension assembly applying a force to the pivot plate to resist rotation between the pivot plate and the adjustable bracket;

a securing element configured to secure the pivot plate at a position within the second range of angles; and a lamp connected to the pivot plate.

14. The light fixture of claim 13, wherein the tension assembly includes a biasing member.

15. The light fixture of claim 13, wherein the first range of angles is approximately 0 to approximately 180 degrees and the second range of angles is approximately 0 to approximately 30 degrees.

16. The light fixture of claim 13, wherein a lamp bracket connects the lamp to the pivot plate.

17. The light fixture of claim 13, wherein the pivot plate includes a first arcuate slot receiving at least a portion of the tensioning assembly and a second arcuate slot spaced from the first arcuate and receiving at least a portion of the securing element.

18. The light fixture of claim 17, wherein the first arcuate slot is positioned above the second arcuate slot.

19. A light fixture assembly comprising:

a housing having a top wall and an opening;

an adjustable bracket rotatably connected to the top wall and rotatable about a first axis;

a pivot plate rotatably connected to the adjustable bracket and rotatable about a second axis different from the first axis;

a lamp bracket movably connected to the pivot plate to adjust the position of the lamp bracket relative to the opening; and a lamp connected to the lamp bracket.

20. The light fixture assembly of claim 19, wherein the lamp bracket is removably connected to the pivot plate.

21. The light fixture assembly of claim 19, wherein a flange extending from the pivot plate is configured to support the lamp bracket in the direction of the first axis.

22. The light fixture assembly of claim 19, wherein the lamp includes a heat sink connected to a first side of the lamp bracket and a light emitter connected to a second side of the lamp bracket.

23. The light fixture assembly of claim 19, further comprising a tension assembly applying a force to the pivot plate to resist rotation between the pivot plate and the adjustable bracket, and a securing element configured to secure the pivot plate at a position within the second range of angles.

* * * * *